US005129470A

United States Patent [19]

Issakainen

[11] Patent Number: 5,129,470

[45] **Date of Patent: * Jul. 14, 1992**

[54] DRILL HOLE FILLING METHOD AND APPARATUS

[75] Inventor: Onni Issakainen, Nokia, Finland

[73] Assignee: Oy Tampella Ab, Tampere, Finland

[ * ] Notice: The portion of the term of this patent subsequent to Dec. 4, 2007 has been disclaimed.

[21] Appl. No.: 594,961

[22] Filed: Oct. 10, 1990

Related U.S. Application Data

[63] Continuation of Ser. No. 269,322, Nov. 10, 1988.

[30] Foreign Application Priority Data

Nov. 11, 1987 [FI] Finland ..... 874966

[51] Int. Cl.[5] ..... E21B 10/60

[52] U.S. Cl. ..... 175/69; 175/211; 299/11

[58] Field of Search ..... 175/65, 69, 205, 209, 175/211, 215, 218, 393; 299/11, 33

[56] References Cited

U.S. PATENT DOCUMENTS 4,372,401 2/1983 Fischer ..... 175/209
4,583,784 4/1986 Uhri ..... 299/11

FOREIGN PATENT DOCUMENTS

66957/86 12/1986 Australia .
385087 7/1986 Austria .
2431113 1/1976 Fed. Rep. of Germany .
2191625 1/1974 France .
2141467 5/1984 United Kingdom .
2169050 12/1985 United Kingdom .

*Primary Examiner*—William P. Neuder
*Attorney, Agent, or Firm*—Pollock, Vande Sande & Priddy

[57] ABSTRACT

The present invention relates to a method for use in connection with a drilling apparatus for drilling a hole and also filling the drilled hole with a filler. A hole is drilled by using a tubular drill rod with a crushing tool provided at the end of the drill rod, with the crushing tool substantially defining the diameter of the hole to be drilled. A first flushing medium is supplied in the course of drilling, through the hole in the tubular drill rod to at least one opening in the crushing tool and into an annular space defined between the walls of the drilled hole and the outer surface of the drill rod, for carrying crushed material out of the drilled hole. After completion of the drilling operation and removal of the crushed material, a filler is delivered into the hole in the tubular drill rod, into the drilled hole and/or into the ground or bedrock surrounding the hole. A second flushing medium is supplied during the final stage of delivery of the filler such as to remove the remaining filler from the drilling apparatus and the crushing tool prior to any subsequent drilling operation.

12 Claims, 3 Drawing Sheets

DRILL HOLE FILLING METHOD AND APPARATUS

This is a continuation of Ser. No. 07/269,332, filed on Nov. 10, 1988.

BACKGROUND OF THE INVENTION

The present invention relates to a drill hole filling method, wherein the first step comprises the drilling of a hole by using a tubular drill rod through which some flushing medium is passed during a hole-drilling operation through at least one aperture in a crushing tool into an annular space defined by the hole and the outer surface of a drill rod for carrying crushed matter out of the hole.

A drill hole formed as described above can be used in a variety of ways for achieving the object of the invention in mining operations. First of all, a drill hole can be filled with a soldering material for anchoring a pit-bracing bolt in the hole. Secondly, a hole can be used for bracing and plugging poor-quality rock by injecting reinforcing material in rock fissures through the drill hole. After this operation, it is naturally possible to effect the fixation of a bolt by means of a soldering material. A third application is the filling of a drill hole with an explosive. In any event, a filler is in a liquid form. In the two first-mentioned cases, the question is primarily about improving the strength and density of rock and in the third case about performing the actual mining work.

The prior art deals mostly with fixation methods of anchoring bolts. For example, Finnish No. 15277 discloses a method for anchring rods in a ground or a bedrock. This method involves the use of a drill rod which is fitted with a drill bit and surrounded by a pipe during a drilling operation. The pipe is removably fastened to the drill rod and drill bit. During the drilling operation, a flushing medium is supplied into a space confined by the anchoring rod and the pipe, and after the drilling operation, the space is filled with a binder. During the supply of the binder, the pipe is being withdrawn from a drill hole, whereby the drill rod together with its drill bit remains in a drill hole as an anchoring rod and is anchored by the action of a binder.

Thus, the method disclosed in the Finnish Patent No. 45277 requires specially built drill rods and drill bits and the only purpose the cited method can be used for is the anchoring of such rods.

On the other hand, prior known is also a method, wherein the fixation of an anchoring bolt is effected by first drilling a hole with a percussion drill followed by withdrawing the drill rod from the drilling hole and introducing into the hole a separate filler supply tube or pipe. Through this tube or pipe a filler is delivered into the hole, whereafter an anchoring bolt is inserted into the hole plugged with the filler.

The above technology is also unfavorable for the reasons discussed below:

First in a broken rock stratum, always found in areas that require reinforcement; the insertion of a pipe or tube in a drill hole is difficult because of rock material tumbling into the hole. In addition, a tube or pipe tends to jam in the hole for the same reason.

Secondly, bringing a pipe or a tube accurately to the mouth of a drill hole is accidental, especially with a hole drilled in uneven terrains since, due to uneven terrain, the drill rod shifts out of normal center and the drill rod also bends at the starting stage.

Furthermore, additives required especially in areas to be reinforced for speeding up the setting of a soldering agent cannot be used, since the setting of a soldering agent in a delivery tube has been possible. After a delivery operation, the mixing apparatus still contains some mixed mass which sets rapidly. The mixing of an additive with a soldering mass is incomplete since mechanical blending cannot be achieved. Neither does the rotation of a reinforcing bolt for mixing purposes in an overhand drill hole filled with a soldering agent provide a desired result, since it can form voids around the bolt in a drill hole with soldering agent trickling out of the drill hole.

Also, circulation of a soldering agent in a supply line for preventing the setting has not served the purpose since the portion entering the drill hole and required by a supply system would not be circulated.

The insertion of a soldering agent tube or pipe as a separate operation is an unnecessary, time-consuming process.

SUMMARY OF THE INVENTION

An object of the present invention is to provide a novel drill hole filling method that can be applied in all fillng operations subsequent to drilling, whether with a soldering agent intended for an anchoring bolt, with a rock or ground reinforcing agent or with an explosive, and the like. In order to achieve this object, a drill hole filling method of the invention is mainly characterized in that a tubular drill rod is used for delivering a filler into a hole and/or ground or bedrock surrounding a hole. This method provides for a very simple, rapid and complete filling of a drill hole. The basic equipment used can be a conventional percussion drill or rotary drilling apparatus which is fitted with a filler supply assembly. On the one hand, the application of this method serves to avoid the use of drill rods only designed for anchoring purposes and on the other hand the introduction of a separate tube or pipe into a drill hole after removing a drill rod from a hole.

Particularly in certain applications, a drill rod is preferably shifted during the supply of a filler in a direction opposite to the drilling direction. In addition, to eliminate air pockets in the filler, the supply of the filler is preferably started at the bottom of a drill hole. Furthermore, it is preferably in terms of mixing the filler that a drill rod be rotated during a filling operation.

The invention relates also to an apparatus for applying the drill hole filling method.

The invention will now be described in more detail in the following specification with reference made to an embodiment illustrated in the accompanying drawings. In the drawings

DETAILED DESCRIPTION OF THE PREFERRED EMBODIMENT(S)

Figure 1:
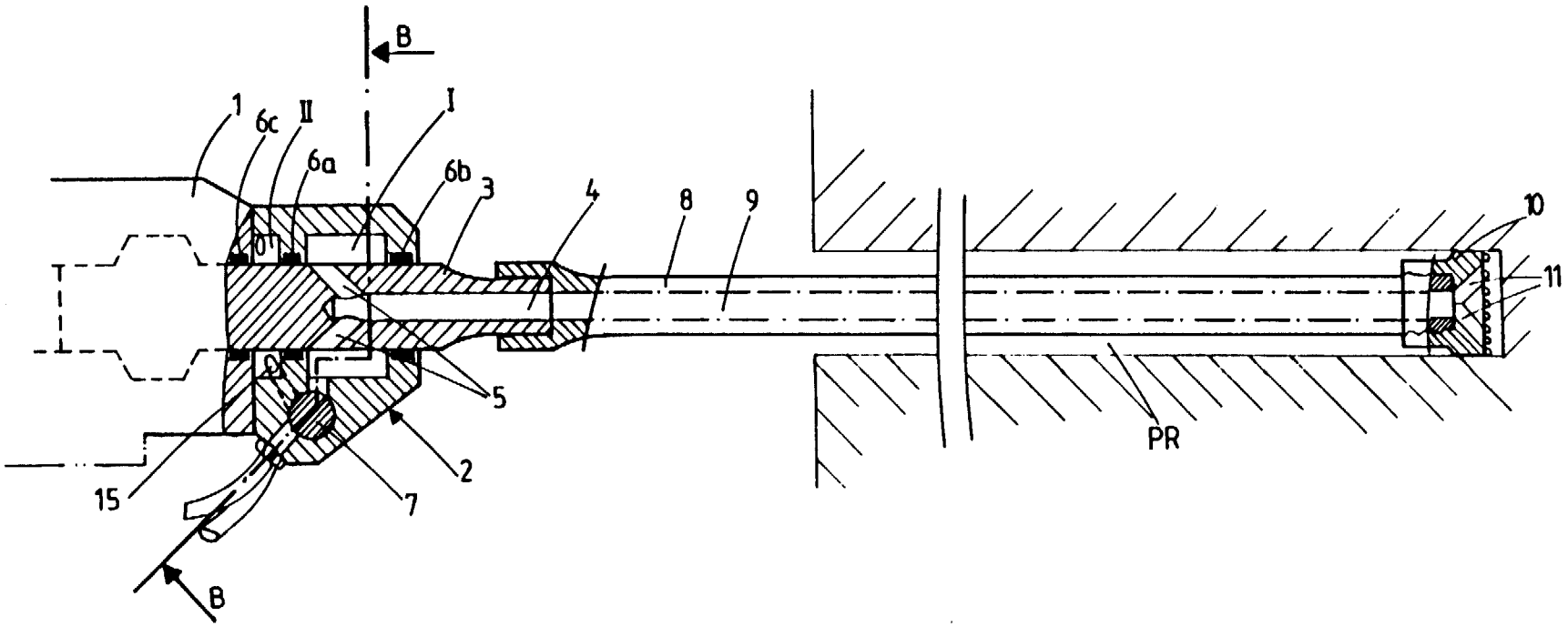
FIG. 1 shows a cross-section of a drilling machine equipped with an apparatus of the invention (section A—A in FIG. 2)

An apparatus shown in the drawings includes a supply housing 2 fastened to the forward section of a drilling machine 1 either fixedly or to be carried thereby. The supply housing 2 includes a substantially cylindrical chamber I surrounding the neck member 3 of a drilling machine. The chamber I is used for supplying both filler and flush water into a passage 4 in the neck member 3 along connecting ducts 5 between chamber I and passage 4. The supply housing 2 includes also a chamber II which similarly surrounds said neck member 3. The chamber II is disposed between drilling machine 1 and chamber I. Into chamber II is supplied flushing medium, particularly water, during the pumping of a filler. Chamber I is provided on either side thereof with sealings 6*a*, 6*b* which seal chamber I relative to the neck member 3. The flushing medium, particularly water, supplied into chamber II for the duration of the delivery of a filler prevents, in the case of a possible sealing damage (primarily sealing 6*a*) the passage of a soldering agent to bearings 6*c* of the forward section of the drilling machine 1. In the present embodiment, the chamber II seals agains the forward wall of a drilling machine and the rear wall of chamber II is provided by the forward wall of the drilling machine 1. A water flow entering the chamber II is passed out of the chamber into a receptacle. The above sealing arrangement serves to prevent the passage of the filler from chamber I to chamber II and, on the other hand, to the atmosphere.

The supply housing 2 further includes a valve 7 for controlling the flows of the filler and flush water and/or scavenging air at various stages in applying the method.

Figure 2:
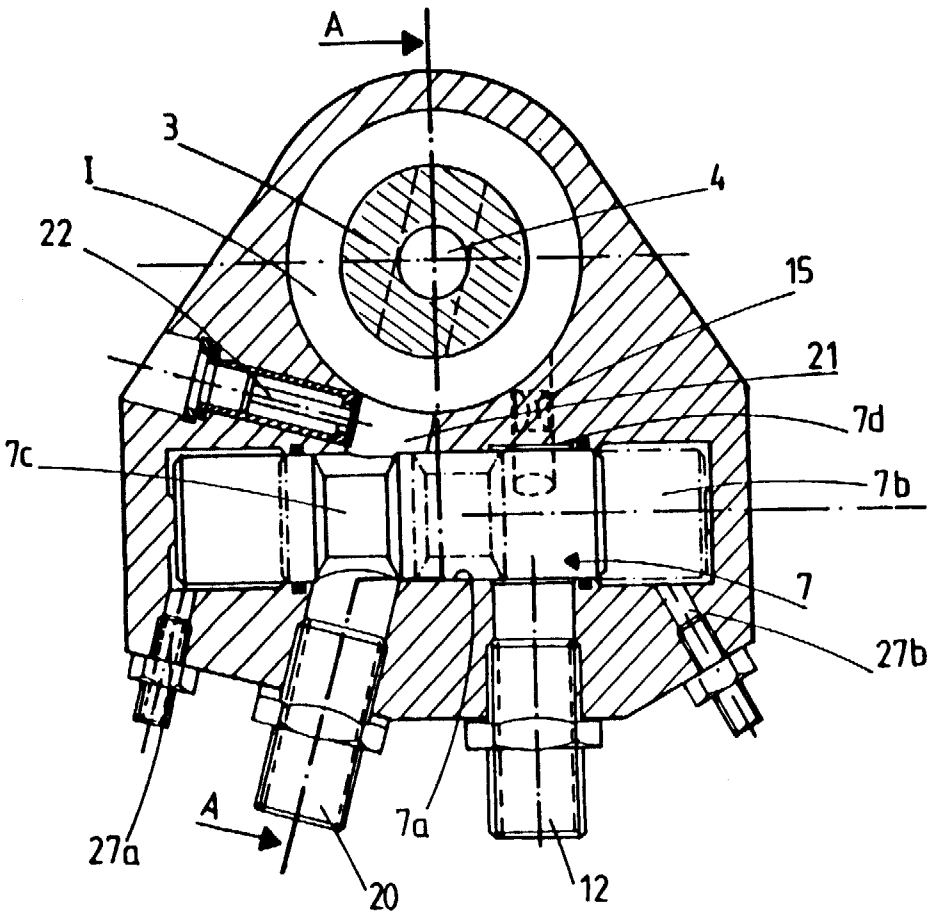
FIG. 2 is a section along B—B in FIG. 1
Figure 3:
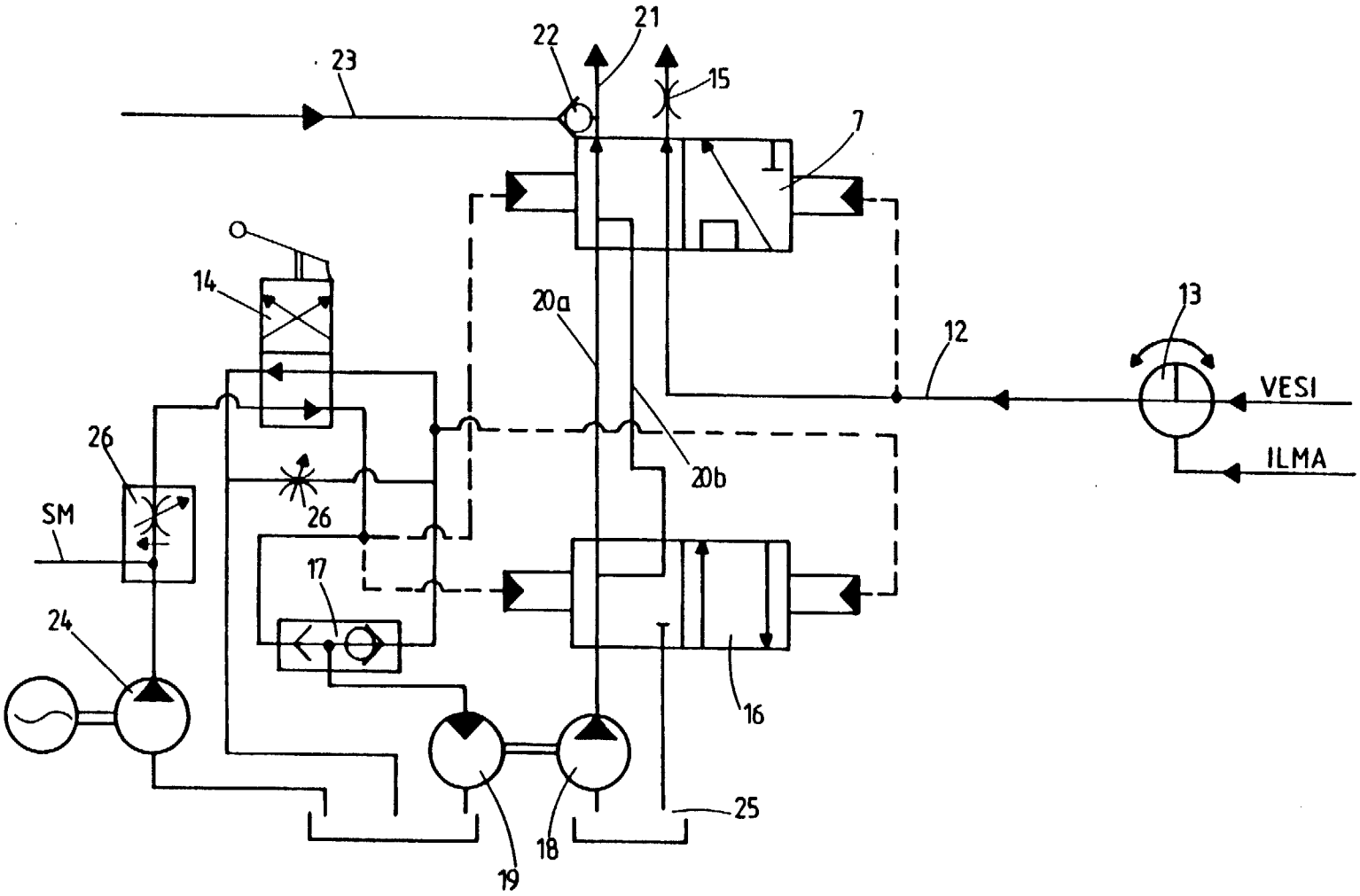
FIG. 3 is a diagram for the hydraulics of an apparatus.

FIG. 3 illustrates a hydraulic diagram to which reference is now made. In a position shown in the diagram, the apparatus is in the course of delivering a filler through the passage 4 in the neck member 3 into a bore 9 in a drill rod 8. The end of the drill rod 8 carries a crushing tool 10 or the like provided with openings 11 for delivering a filler into a drill hole PR. The drill rod 8 can possibly be provided with extra passages adjacent to the crushing tool 10. Water or compressed air is carried along a line 12 to the valve 7 throuh a three-way valve 13. In a second position of the three-way valve 13, it is possible during a drilling operation to supply compressed air through chamber I into the bore 9 of the drill rod 8. An operating valve 14 provides for the control of valve 7 by means of the pressure of a hydraulic pump 24 to the position shown in FIG. 2, the water being supplied through line 12 through a throttle 15 located downstream of the valve 7 (see FIG. 1). The purpose of throttle 15 is to provide a spray-like water flow into chamber II for a more effective flushing of the neck member 3 within the confines of chamber II. Furthermore, the operating valve 14 is used to adjust, by means of the pressure of the hydraulic pump 24, a circulating valve 16 to the illustrated position. Similarly, the hydraulic pump 24 is used to effect through a reversible countervalve 17 a pressure fluid flow for the hydraulic motor 19 of a filler pump 18 for pumping action. From the circulating valve 16 there is a connection to valve 7 along a delivery tubing 20*a*, 20*b* consisting of two tubes. During the pumping of a filler, both delivery tubes 20*a*, 20*b* operates in carry filler to the valve 7. Downstream of valve 7, a filler pumping lines 21 is provided with an additive supply line 23, a valve 22 therein being adapted to prevent the passage of the filler into the additive supply line 23. The above operation provides for the passage of the filler and a possible additive into chamber I from a filler store 25 and further the passage of water into chamber II by using line 12.

When the apparatus is put into actual drilling operation, the upper block of the operating valve 14 is set in action. Thus, first of all, the hydraulic pump 24 sets the right-hand block of the circulating valve 16 in operation. On the other hand, the right-hand block of the valve 7 is set in action with the removal of control on the left-hand block and as the pressure prevailing in line 12 acts on valve 7. This produces for a the filler a circulation line 25-18-16-20*a*-7-20*b*-16-25 and water and/or air travels along line 12 into chamber I. On the other hand, the flow of hydraulic fluid of the hydraulic pump 24 to the motor 19 now proceeds through a throttling control valve 26. Hence the flow proceeding through the reversible counter-valve 17 regulates itself to a proper rate regarding the necessary output of circulation effected by means of the motor 19.

FIG. 2 in particular shows the structure of the valve 7 and its associated elemnts 15 and 22 as well as their disposition in connection with the supply housing 2. The supplying housing 2 is provided with an elongated valve chamber 7*a* fitted with a valve rod 7*b* adapted to be movable in its longitudinal direction. The supply housing 2 is provided with bores 27*a*, 27*b* which communicate with the opposite ends of the valve chamber 7*a* and through which the position of rod 7*b* is controlled by a control pressure fluid acting on the end of the rod. Rod 7*b* is provided with a recess or a notching 7*c* which in the position of rod 7 shown by solid lines in FIG. 2 is in alignment with a line 20 (20*a*, 20*b*) for effecting into the chamber I the delivery of a filler and a possible additive (valve 22) supplied into the filler downstream of the valve 7. The supply of a flushing medium into chamber II through a throttle 15 fitted downstream of the valve 7 is effected through an annular space 7*d* formed in valve chamber 7*a* at line 12. As a control pressure fluid is used to shift the rod 7*b* to the right-hand position shown with dash-and-dot lines in FIG. 2, said line 20 is closed as the left-hand end of rod 7*b* settles at line 20 and the recess or notching settles partially at line 12, the flow of flushing medium issuing from line 12 being distributed into the chambers I and II.

In connection with filling a hole with a soldering agent, the operation of the apparatus of the present invention proceeds as follows. The drilling of the hole is effected with a drilling machine normally to a prescribed distance. After the drilling, the drilling operations are stopped. Air pressure is set in line 12 by turning the threeway, valve 13 counter-clockwise from the position shown in FIG. 3. Thus, the flushing water used in a drilling operation discharges from chamber I, from the central bore 9 of the drill rod 8 and from the drill hole PR.

The pumping of a soldering agent is started by shifting the operating valve 14 to the pumping position shown in FIG. 3, the hydraulic pressure pushing valves 7, 16 and 17 to the position shown in FIG. 2. The oil flows passing to the motor 19 and along a line SM to the operating motor (not shown) of the drilling machine 1 are synchronized with a separate distributing valve 26 to correspond to each other such that a crushing tool 10 moves in the drill hole PR at a speed which is opposite to the drilling direction and equal to or slightly lower than the speed at which the soldering agent is filling a drill hole. The drill rod is rotated during this movement.

The flush water is switched on after the pumping is started, the water flushing chamber II from which the water is discharged onto the ground or into a separate receptacle.

The pumping is preferably stopped by means of the operating valve 14 before a drill hole is filled all the way. After the pumping is stopped, the hydraulic pressure shifts valve 7 to a position for allowing water into the chamber I whereby a soldering mass, which lies in the chamber I and inside the equipment, is carried in front of the water into the drill hole PR and fills the part of the drill hole that was not completely full. This is to avoid the formation of waste mass.

When the pumping is stopped by means of the operating valve 14, hydraulic pressure shifts valves 7 and 16 to a circulating position and the pumping proceeds at a decreased rate through line 20*a*, 20*b* back to the container 25.

If additives are to be employed, those are pumped through valve 22 to mix them with a soldering agent. In this case it is particularly preferable to use the rotation of drilling machine 1 for mixing an additive in the hole PR.

After the drill hole PR is filled with a soldering agent, a bolt is inserted therein in a conventional manner.

In reference to what is explained above, some advantages of the invention will now be described over the prior art especially when using a soldering agent.

A drill rod 8 serving as a soldering agent supply tube, along with its crushing tool 10, always reaches the bottom of a drill hole regardless of the type of rock since all normal basic operations (if necessary, percussion as well as rotation and feed) are available for this purpose. The operating cycle will be more rapid since some stages are omitted.

A soldering agent supply line need not be completely cleaned during short breaks by virtue of providing a possibility of circulation.

Supply of an additive into a soldering mass can be effected within such section of a supply line which is flushed clean during the drilling. The length of the drill rod serving as a supply tube is always suitable for a particular drill hole PR. This advantage is obvious especially whenever extended rod drilling must be used for reaching a required hole depth.

The filling method and apparatus offer also a possibility of using prestressed bolts. An additive is only used at the early stage of pumping, whereby the portion remaining on the bottom of hole sets more rapidly than the portion closer to the mouth of drill hole. Thus, a bolt can be prestressed after the portion on the bottom has set.

The mixing of an additive in a soldering agent can be effected by rotating a drill rod. A partial mixing occurs in chamber I as the neck member is rotating. This means that ducts 5 are in rotating motion with a result that a soldering agent in the chamber is also subjected to rotating motion. The final mixing occurs in the drill hole as a soldering agent discharges through openings 11 in the crushing tool 10. The tip of the crushing tool 10 is fitted with studs which provide further mixing.

During the pumping of a soldering agent, a pressure loss experienced in delivery tubing 20*a*, 20*b* is less, since the flow of a soldering agent can be divided between two tubes.

I claim:

1. A method for use in connection with a drilling apparatus for drilling a hole and filling said drilled hole with a filler, said method including the steps of:

a) drilling a hole by using a tubular drill rod with a crushing tool provided at the end of said drill rod, said crushing tool substantially defining the diameter of the hole to be drilled;

b) supplying a first flushing medium in the course of drilling, through a bore extending longitudinally through the tubular drill rod to at least one opening in said crushing tool and into an annular space defined between the walls of the drilled hole and the outer surface of said drill rod, for carrying crushed material out of the drilled hole;

c) delivering a filler into said bore in the tubular drill rod, into said drilled hole and/or into the ground or bedrock surrounding said hole, after completing said drilling operation and removal of said crushed material; and d) supplying a second flushing medium during the final stage of delivery of said filler for removal of the remaining filler from said drilling apparatus and said crushing tool prior to any subsequent drilling operation.

2. A method for use in connection with a drilling apparatus for filling a drill hole with a filler simultaneously with the drilling phase said method including the steps of:

a) drilling a hole by using a tubular drill rod with a crushing tool provided at the end of said drill rod, said crushing tool substantially defining the diameter of the hole to be drilled;

b) supplying a first flushing medium in the course of drilling through a supply housing connected to a neck member in said drilling apparatus, through said neck member and a bore extending longitudinally through the tubular drill rod to at least one opening in said crushing tool and into an annular space defined between the walls of the drilled hole and the outer surface of said drill rod, for carrying crushed material out of the drilled hole;

c) subjecting said filler to an internal circulation within said drilling apparatus during the period of the drilling operation;

d) delivering, after completion of the drilling and material removing phase, said filler through said supply housing into said neck member and said bore in the tubular drill rod, into said drilled hole and/or into the ground or bedrock surrounding the hole, wherein said drill rod is moved during the delivery of said filler in a direction opposite to the drilling direction; and e) supplying a second flushing medium through said supply housing for removing said filler from the interior of said supply housing, said neck member, said drill rod and said crushing tool during the final stage of delivery of said filler, said second flushing medium thus effecting the displacement of said filler remaining in said drilling apparatus into said hole, such that said supply housing, said neck member, said drill rod and said crushing tool are substantially free of said filler after the filling stage to be used for the next drilling phase.

3. A method according to claim 1, wherein said drill rod is moved, during the delivery of said filler, in a direction opposite to the drilling direction.

4. A method according to claim 1, wherein said drill rod is rotated during the delivery of said filler.

5. A method according to claim 1, wherein said flushing medium is flushing water.

6. A method according to claim 1, further comprising a step of supplying an additive, such as an additive for a more rapid setting of a soldering agent, into said filler at a point downstream of said flushing medium supply.

7. A method according to claim 1, wherein said filler is subjected to an internal circulation in said drilling apparatus during the periods of drilling operations.

8. A method according to claim 2, wherein said drill rod is rotated during the delivery of said filler.

9. A method according to claim 2, wherein said second flushing medium is flushing water.

10. A method according to claim 2, further comprising a step of supplying an additive, such as an additive for a more rapid setting of a soldering agent, into said filler at a point downstream of said second flushing medium supply.

11. A method according to claim 2, further comprising means for flushing said neck member located between said drilling apparatus and a filler supply point in said neck member.

12. A method according to claim 2, wherein said filler supply point in said neck member is adapted for delivering a flushing medium employed in a drilling operation.

* * * * *